US006189505B1

(12) United States Patent
Reid

(10) Patent No.: US 6,189,505 B1
(45) Date of Patent: Feb. 20, 2001

(54) DISC TYPE THROTTLE STOP

(76) Inventor: Dennis Reid, 107 Rodeo Ct., Lafayette, CA (US) 94549

( * ) Notice: Under 35 U.S.C. 154(b), the term of this patent shall be extended for 0 days.

(21) Appl. No.: 09/150,084

(22) Filed: Sep. 9, 1998

(51) Int. Cl.[7] ..... F02D 1/00
(52) U.S. Cl. ..... 123/336; 123/337; 123/403
(58) Field of Search ..... 123/336, 337, 123/403, 442

(56) References Cited

U.S. PATENT DOCUMENTS

| | | | | |
|---|---|---|---|---|
| Re. 32,474 | | 8/1987 | Reid . | |
| 4,124,012 | * | 11/1978 | Fuller, Jr. | 123/403 |
| 4,363,302 | * | 12/1982 | Pischinger | 123/403 |
| 4,467,219 | | 8/1984 | Reid . | |
| 4,524,741 | | 6/1985 | Corbi . | |
| 4,596,215 | | 6/1986 | Palesotti . | |
| 4,691,670 | * | 9/1987 | Bonisch et al. | 123/403 |
| 4,784,099 | | 11/1988 | Noe et al. . | |
| 4,976,237 | | 12/1990 | Bollinger . | |
| 5,454,357 | * | 10/1995 | Elder | 123/337 |
| 5,596,966 | * | 1/1997 | Elder | 123/337 |
| 5,609,217 | | 3/1997 | Honda et al. . | |
| 5,622,088 | | 4/1997 | Reid . | |
| 5,642,712 | | 7/1997 | Biondo . | |
| 5,652,468 | | 7/1997 | Reid . | |
| 5,669,352 | | 9/1997 | Mitchell . | |
| 5,694,817 | | 12/1997 | Reid . | |
| 5,778,851 | * | 7/1998 | Elder | 123/336 |
| 5,803,045 | * | 9/1998 | Adamisin et al. | 123/336 |

* cited by examiner

*Primary Examiner*—John Kwon
(74) *Attorney, Agent, or Firm*—Donald C. Feix

(57) ABSTRACT

A disc type throttle stop selectively regulates the power of an internal combustion engine by controlling the flow between an air metering device and the intake valves and presents substantially no restriction to the flow in the full open position of the throttle stop at wide open throttle conditions of the engine.

22 Claims, 16 Drawing Sheets

DISC TYPE THROTTLE STOP

This invention relates to a throttle stop apparatus for selectively regulating the power of an internal combustion engine.

This invention relates particularly to a throttle stop apparatus which is mounted between the intake valves and an air metering device of the engine. The throttle stop apparatus is movable between a full open position and at least one flow restricting position for selectively regulating the power of the engine by controlling the flow from the air metering device to the intake valves. The throttle stop apparatus is constructed to create substantially no restriction to said flow in the full open position at wide open throttle conditions of the engine.

BACKGROUND OF THE INVENTION

In the motor sport of drag racing, two cars line up side by side on a starting line. A series of starting lights mounted on a "Christmas tree" sequentially count down until a green light appears which signals the start of the race. The racers take off from the starting line and race each other to the end of the track which consists of a straight two lane road typically up to a quarter mile in length. The cars are timed by an electronic unit that times how long it takes for each car to run the length of the race course from the starting line to the finish line. The amount of time required to traverse the race track is called the "Elapsed Time" or more commonly, the "ET."

In some classes of drag racing, notably "Bracket Racing" or "Super Class Racing", the driver, the race track, or the race sanctioning association selects the ET that the car should run. This is known in racing as the "Dial In." The object of a racer is to get to the finish line ahead of his opponent without going quicker that his "Dial In." If the racer goes quicker than his "Dial In" and his opponent does not, or if both racers go quicker than their "Dial Ins", the racer who goes furthest under his "Dial In" gets disqualified and his opponent wins the race.

The purpose of this type of racing is to minimize the cost of campaigning a race car. In this type of racing, a slow car can race a fast car by having the racetrack "handicap" the fast car. "Handicapping" allows the slower car to start first by an amount of time that is equal to the difference between the "Dial Ins" of the two cars (the handicap). In theory, if both cars leave the starting line exactly when their respective green Christmas tree light turns on, and they run perfectly on their "Dial In", they should cross the finish line at the same time.

The other form of racing using this same method is the "Super Classes." In these classes, both cars are assigned the same "Dial In" and therefore, both cars leave the starting line at the same time. They race each other and try to finish first without going quicker than the assigned "Dial In."

Again, the purpose is to minimize the cost of racing.

In the "Super Classes" where the "Dial In" is assigned by the track or the race sanctioning body, the race car engines must produce excess power so that they can run quicker than the "Dial In." This is so that if track or weather conditions cause a car to run slower than normal, the car will still have enough power to run at least as quick as the "Dial In."

This creates a situation where the car will always run too quickly under normal conditions and so it must be slowed down. Devices known as "throttle stops" were created to selectively limit the power of race car engines. By setting the "throttle stop", the engine power level can be adjusted up or down to allow the car to run at exactly the "Dial In" elapsed time regardless of the track or weather conditions. An additional benefit of using a "throttle stop" is that it can be turned on and off (changed from full power to "limited" or "throttle stopped" power) as the car goes down the track. This usually results in a car having a higher speed at the end of the track than would normally be expected for a car that runs the selected ET or Dial In. Thus, a faster car chases a slower car which is an advantage because the faster car driver can judge how fast he is closing in on the slower car and he can also judge when he will cross the finish line. The slower car driver must continually look over his shoulder to see the faster car coming up behind him and then he must turn around to look at the finish line. Because of the above mentioned advantages of using a "throttle stop", they are widely used and the art is well known.

There are two basic types of "throttle stop".

One type is a "linkage style" (see, for example, Dedenbear Products, Inc. catalog, volume 5, page 18 model TS-10) which is a collapsible link within the throttle linkage between the gas pedal and the fuel metering device (carburetor or fuel injector). The throttle linkage length changes and therefore the butterflies on the fuel metering device close and limit the amount of air flow (engine power). This style is inexpensive and easily adaptable to many types of fuel metering devices, however, its disadvantage is that most racing fuel metering devices do not perform well under partial throttle conditions and therefore the cars performance becomes erratic.

The second and currently preferred type of throttle stop is the "baseplate" style. In this throttle stop, a second set of butterflies located underneath the fuel metering device controls the total air/fuel mixture flow after the fuel has been injected into the airstream by the fuel metering device. The advantage of this type of throttle stop is that at all times during a race, the fuel metering device runs at its optimum condition of wide open throttle so that the fuel metering and therefore the car performance stays very consistent. This style of throttle stop was created in 1987 by Dedenbear Products, Inc. and has been used to win many World drag racing championships (see Dedenbear Products, Inc. catalog, volume 5, pages 15–17 models TS-1 and TS-5).

Racing has progressed and the trend currently is to build large displacement, high horsepower engines in order to create very high speeds at the finish of the race.

Huge fuel metering device air flow rates are required to produce this high horsepower and an effect that is starting to become important is the impediment to air flow created by the second set of butterflies located in the throttle stop.

SUMMARY OF THE PRESENT INVENTION

In accordance with the present invention, a new type of throttle stop combines the advantages of a "base plate" style stop with the free flowing characteristics of a "linkage" style stop.

This new type of throttle stop is best described as a "disc" style stop. In one specific embodiment, the "disc" style stop consists of two counter rotating discs stacked on top of each other machined with holes that match the bores of the fuel metering device. As the discs are rotated toward the closed condition, the holes start to overlap and block each other, which chokes off the air/fuel flow. Rotating the discs to the fully open position results in substantially perfectly open bores (holes) that match the fuel metering device bores. In this position, there is substantially no restriction to air/fuel flow so maximum engine horsepower is achieved.

In all types of throttle stops, there is a requirement to use some means to activate the stop mechanism. This has typically been done by using an electric solenoid or a pneumatic cylinder to move the throttle stop mechanisms. Electric solenoids are desirable because they are very simple, reliable, and inexpensive. The drawback to using a solenoid is that it opens and shuts instantaneously. On a car with a high horsepower engine, opening and shutting the throttle stop quickly can often cause the cars rear drive tires to spin (lose traction) due to the abrupt change in the engine power level and driving becomes dangerous.

Because of this problem, pneumatic actuators are often used. Adjustable flow limiters in the air supply lines to the actuators are used which regulate how fast the throttle stop opens and closes. By setting the speed that the stop opens and closes, a smooth transition from full power to limited power and vice versa results and the car remains stable as it goes down the track.

A disadvantage of both pneumatic and solenoid actuators is that they tend to open and close at the same speed for their entire stroke.

The "disc" stop embodiment of the present invention has the capability of adding a second actuator that can open or close the stop to a partial intermediate position at one speed, and then the main actuator can open or close the stop to the full position at its desired speed. This allows two or more distinctive power settings of the engine with two or more distinctive actuation speeds thereby allowing complete tailoring of the engine power settings to match the characteristics of the car.

Electronic timers are used to activate the throttle stops in one specific embodiment of the present invention.

In a specific embodiment of the present invention, the throttle stop consists of a body that is comprised of a top and bottom half that contain the moving parts. These halves are bolted together and the unit is mounted and sealed with gaskets between the intake manifold and the fuel control device. Inside the lower half is mounted two flow control discs, one above the other, that have holes machined into them that correspond to the bores of the fuel metering device bores. The flow control discs rotate about a center pin in the lower half. Extension springs are connected to the lower body and the flow control discs.

Two link bars connect the flow control discs to two linkage discs. The two linkage discs are cross connected by an interconnect link. The linkage discs are held in place and rotate about their own center pins. All of the discs and links are connected together by pins that allow free rotation of the links about the pins. One of the linkage discs is the "drive" disc and the other linkage disc is the "slave" or "driven" disc.

The "drive" linkage disc is rotated by means of a scotch yoke block attached to the end of the main actuator pneumatic cylinder rod. The second actuator cylinder rod pushes against the scotch yoke block. Each of the pneumatic cylinders is activated by compressed gas supplied to the cylinders through flow control valves and electric solenoid valves.

A stop adjusting nut is located at the end of the shaft protruding out of the back of the main actuator. This nut is turned in and out to set the stroke of the main actuator pneumatic cylinder rod in the closed position. This limits how far the flow control discs can rotate and therefore how much of the air/fuel flow that can be choked off in the closed position. A lock nut prevents the adjusting nut from vibrating to an undesired setting.

The secondary actuator pneumatic cylinder is threaded into the units main body and is set by either using shims between the cylinder body and the main body or by rotating the cylinder and locking its position with a thin jam nut. Shim or jam nut choice is determined by the amount that the cylinder is backed out. Moving the cylinder into the main body increases the opening of the flow control discs at the intermediate opening position.

This specific embodiment is a good combination of manufacturing cost, performance, accuracy, simplicity, and desirability.

In other embodiments of the present invention, different apparatus are utilized.

In one alternative embodiment, sliding plates are used in place of the rotating discs.

In another embodiment, flapper valves are located to the side of the air flow path, and the flapper valves rotate into the air stream. In this embodiment the throttle shafts are not located in the flow path, but are located to the side of the flow path; and the plates rotate into the flow stream.

In another embodiment, a rotating rod has through holes. This comprises large diameter shafts that have holes bored through them that correspond to the fuel metering device holes. As the rods rotate, the through holes become covered and thus restrict the flow.

In other embodiments, the linkage discs and connecting links are not used. Instead, other types of drive linkages are used.

In one specific embodiment the drive linkages comprise rotating gears, and the linkage discs are replaced with meshing gears that eliminate the interconnect link.

In another embodiment gear drive flow control discs are used. The flow control discs have gear teeth either on the outer periphery or on an inner surface and are driven directly with another gear (rotary) or rack (linear).

In another embodiment a rack and pinion actuating linkage is used. A gear drives a rack connected to the air flow control disc.

In a specific embodiment the disc or plate itself is a gear, and a rack drives it. This is particularly useful for a sliding plate type throttle stop.

In other embodiments, methods other than pneumatic cylinder operating discs and linkages are used.

In one embodiment an electric solenoid is used.

In another embodiment a direct pneumatic actuator is used. The pneumatic cylinder is directly linked to the flow control disc.

In another embodiment, dual cylinders are used to operate each flow control disc 49 and 51 individually.

DC or AC motors are also used in place of the pneumatic cylinders. A lead screw that is spun by a motor is used to create linear motion. Actuation speed is set by motor voltage or frequency.

A screw drive is used in another embodiment. The screw is driven by a source other than a motor.

In one embodiment the source is an electric solenoid creating a rotary motion by means of proper linkages.

In another embodiment the source is a rack and pinion driven by a pneumatic cylinder or by a small air turbine driven off compressed gas.

In another embodiment a stepper motor (linear or rotary) is used. This is similar to DC and AC motors except that each pulse given to the motor causes the output shaft to step a specified amount of rotation or linear motion. In this embodiment infinite changes in speeds and stages of opening/closing are provided. This embodiment does not require a stop setting bolt since the position of the air flow disc is known by keeping track of how many steps were sent to the stepper motor.

Cam operation is used in another embodiment. A cam (either rotary or linear) is used to operate the flow control plates in place of linkages or gears.

In another embodiment, engine oil is used in place of pneumatic or electrical means. Engine or transmission pressurized oil is used for the power source of the throttle stop actuator.

In other specific embodiments, two or more stage operation of the stop is provided instead of just one opening/closing position or rate.

In other embodiments of the present invention, the stop setting is adjustable. Means are provided to adjust one or all of the open/closed settings.

In all embodiments of the present invention, a throttle stop apparatus is mounted between the intake valves and an air metering device of the engine. The throttle stop apparatus is movable between a full open position and at least one flow restricting position. The power of the engine is regulated by actuating the throttle stop apparatus to a selected position to control the flow from the air metering device to the intake valves. The throttle stop apparatus is constructed to create substantially no restriction to said flow in said full open position at wide open throttle conditions of the engine.

The throttle stop apparatus and methods of the present invention permit regulation of the power of the engine by positioning of the throttle stop apparatus.

Throttle stop apparatus and methods which incorporate the features noted above and which are effective to function as described above comprise specific objects of this invention.

Other and further objects of the present invention will be apparent from the following description and claims and are illustrated in the accompanying drawings, which by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWING VIEWS

FIG. 1 is a side elevation view, partly in cross section, of a prior art baseplate style throttle stop and carburetor at wide open condition. The prior art baseplate style throttle stop shown in FIG. 1 incorporates throttle stop butterflies positioned beneath the carburetor butterflies.

Figure 1:
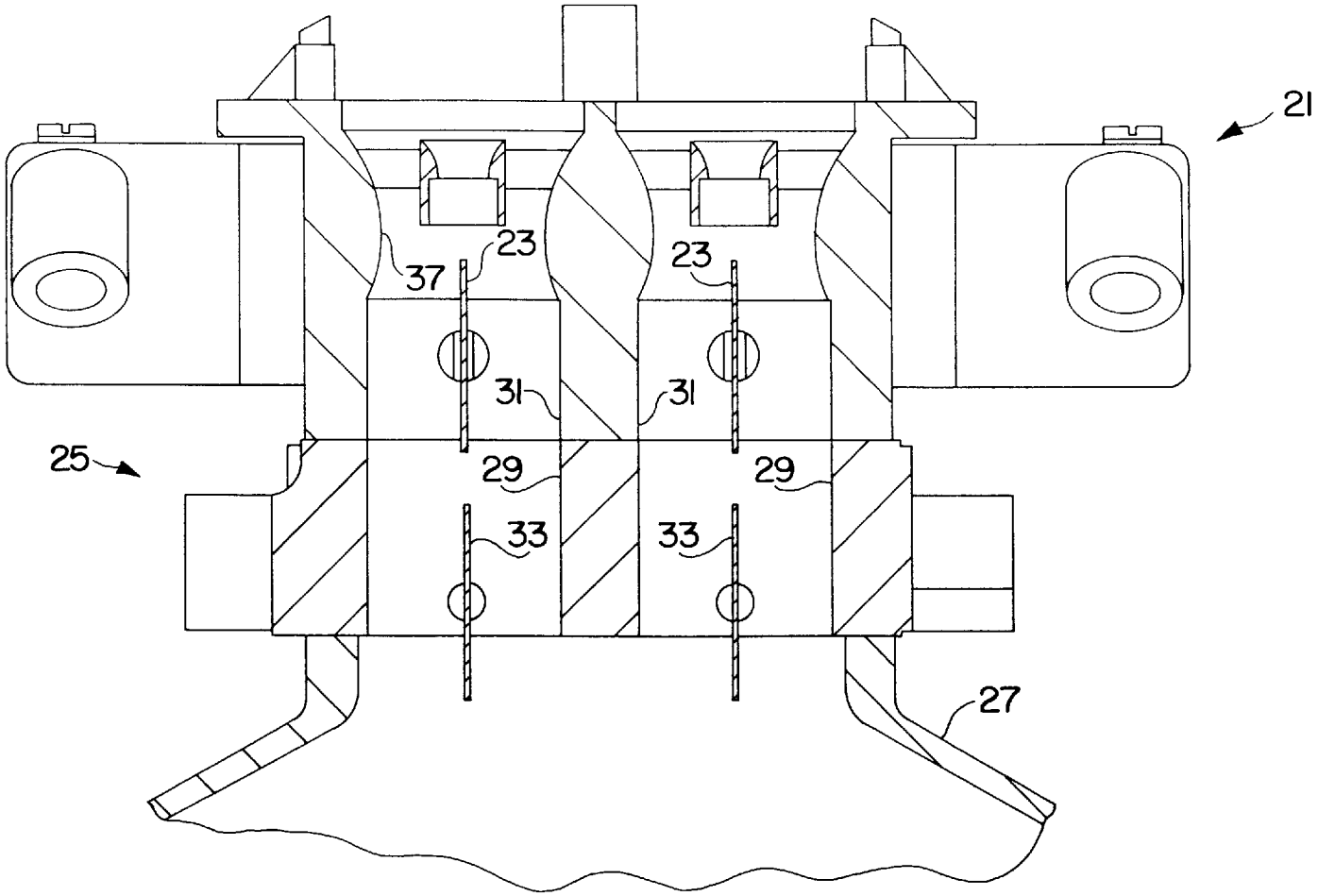
FIG. 1 PRIOR ART
FIGS. 1–4 show a prior art baseplate (butterfly) style throttle stop.
Figure 2:
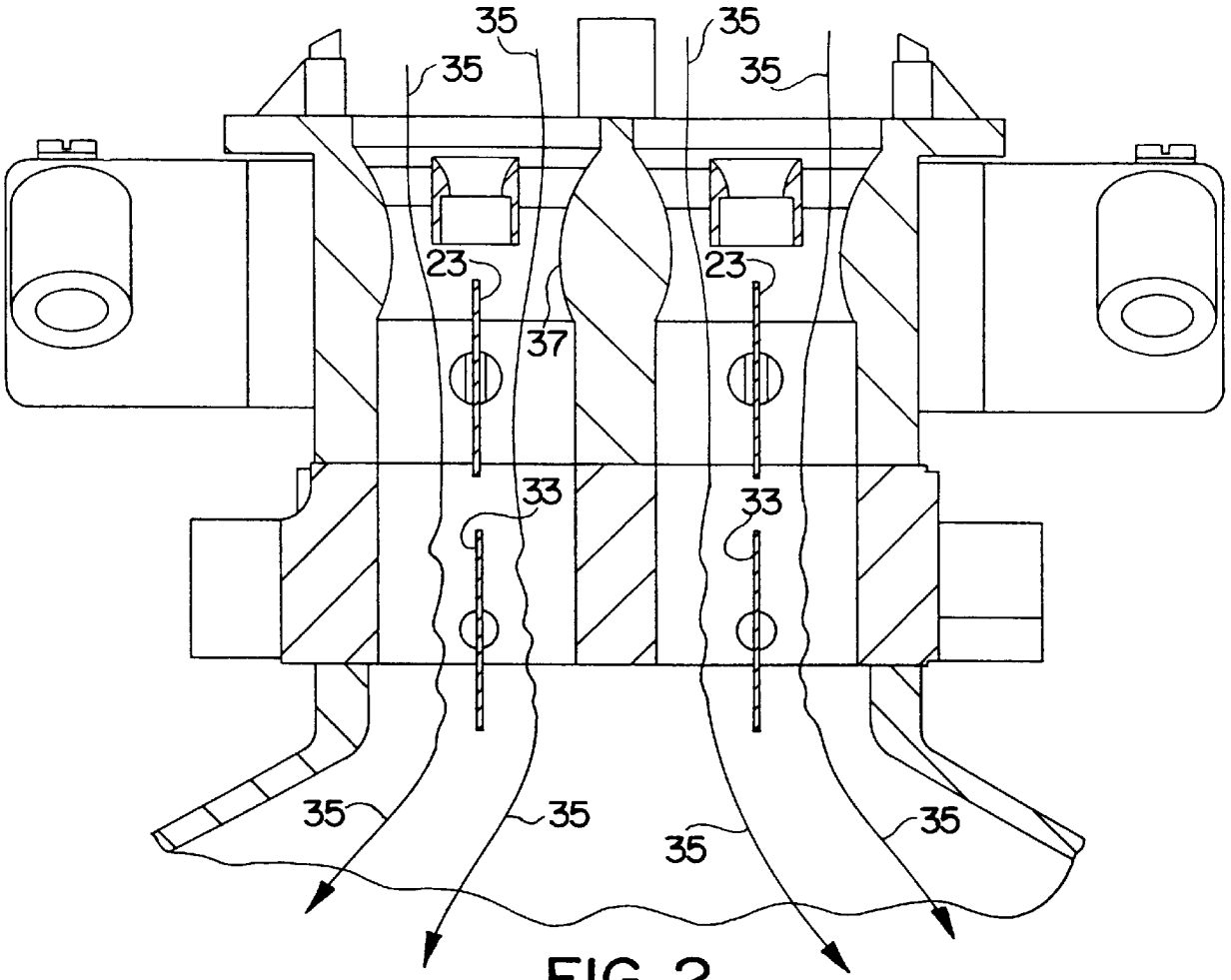
FIG. 2 PRIOR ART

FIG. 2 is a side elevation view like FIG. 1 but includes flow lines showing the path of the air/fuel flow. FIG. 2 illustrates how the air expands after passing the carburetor butterflies and how the air/fuel flow must then split and then contract as it goes past the throttle stop butterflies. The prior art throttle stop butterflies shown in FIG. 2 produce a flow restriction in the path of the air/fuel flow through the throttle stop, and the flow restriction produces an unwanted source of turbulence. This turbulence, even at the illustrated wide open position of the throttle stop butterflies, can produce a 10–50 horsepower loss in large displacement, high horsepower engines.

Figure 3:
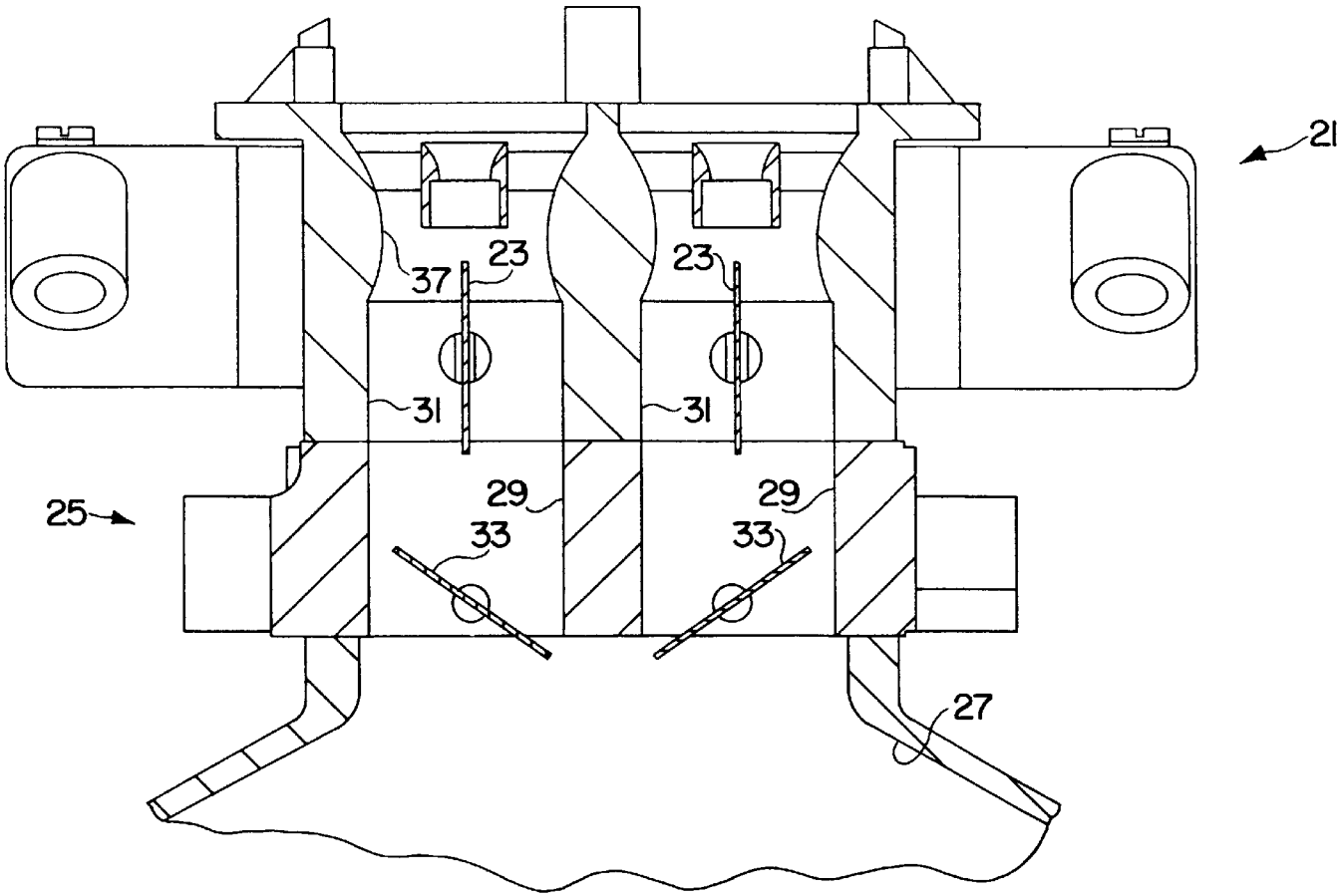
FIG. 3 PRIOR ART

FIG. 3 is a side elevation view, like FIG. 1, of a prior art baseplate style throttle stop and carburetor at the closed (restricted) condition of the butterflies in the throttle stop.

Figure 4:
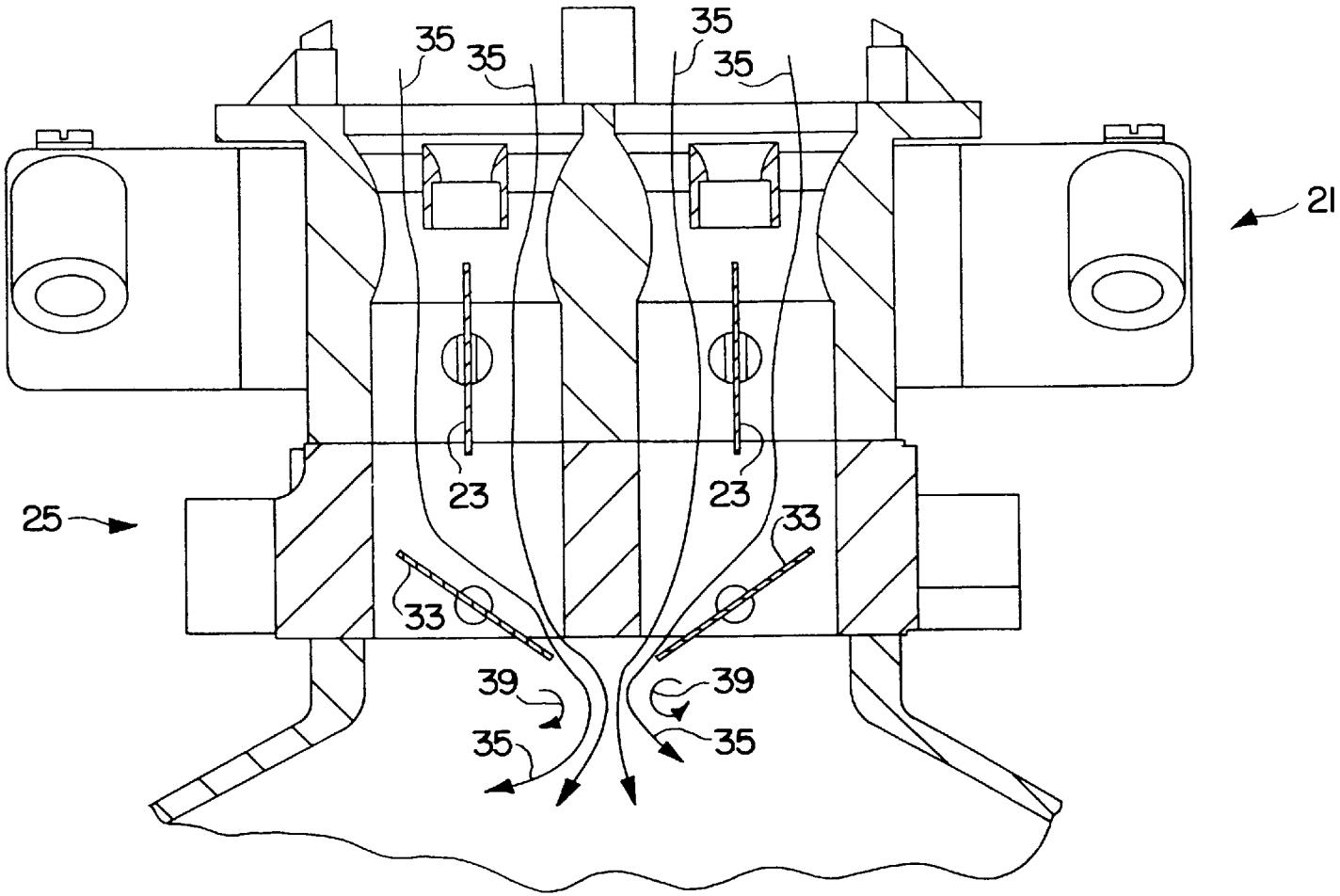
FIG. 4 PRIOR ART

FIG. 4 is a side elevation view like FIG. 3, but includes flow lines showing the path of the air/fuel flow. FIG. 4 illustrates how the throttle stop butterflies in the closed position produce a major change and significant turbulence in the path of the air/fuel flow through the closed position of the prior art throttle stop.

FIGS. 5–10 show one embodiment of a throttle stop constructed in accordance with the present invention. The embodiment shown in FIGS. 5–10 is a disc style throttle stop.

Figure 5:
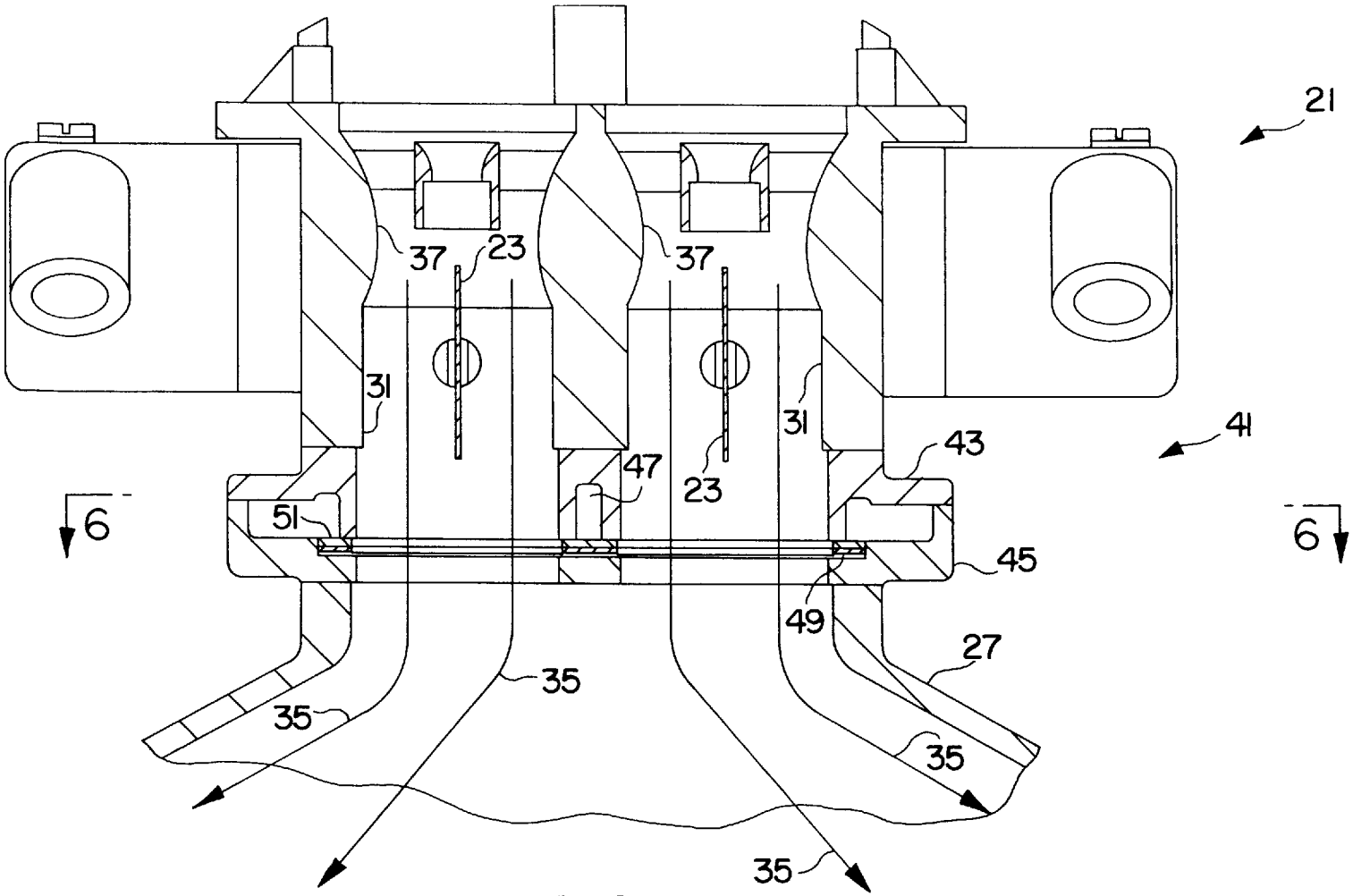

FIG. 5 is a side elevation view showing a disc style throttle stop constructed in accordance with one embodiment of the present invention. FIG. 5 is partly in cross-section to show details of construction. FIG. 5 shows the throttle stop of the present invention at wide open condition. FIG. 5 illustrates the lack of restriction and the continuation of existing flow patterns. The closed condition (see FIG. 7 and FIG. 10 below) of the throttle stop of the present invention has the same pattern of flow although the amount of flow is restricted by the area of the opening between the discs.

Figure 6:
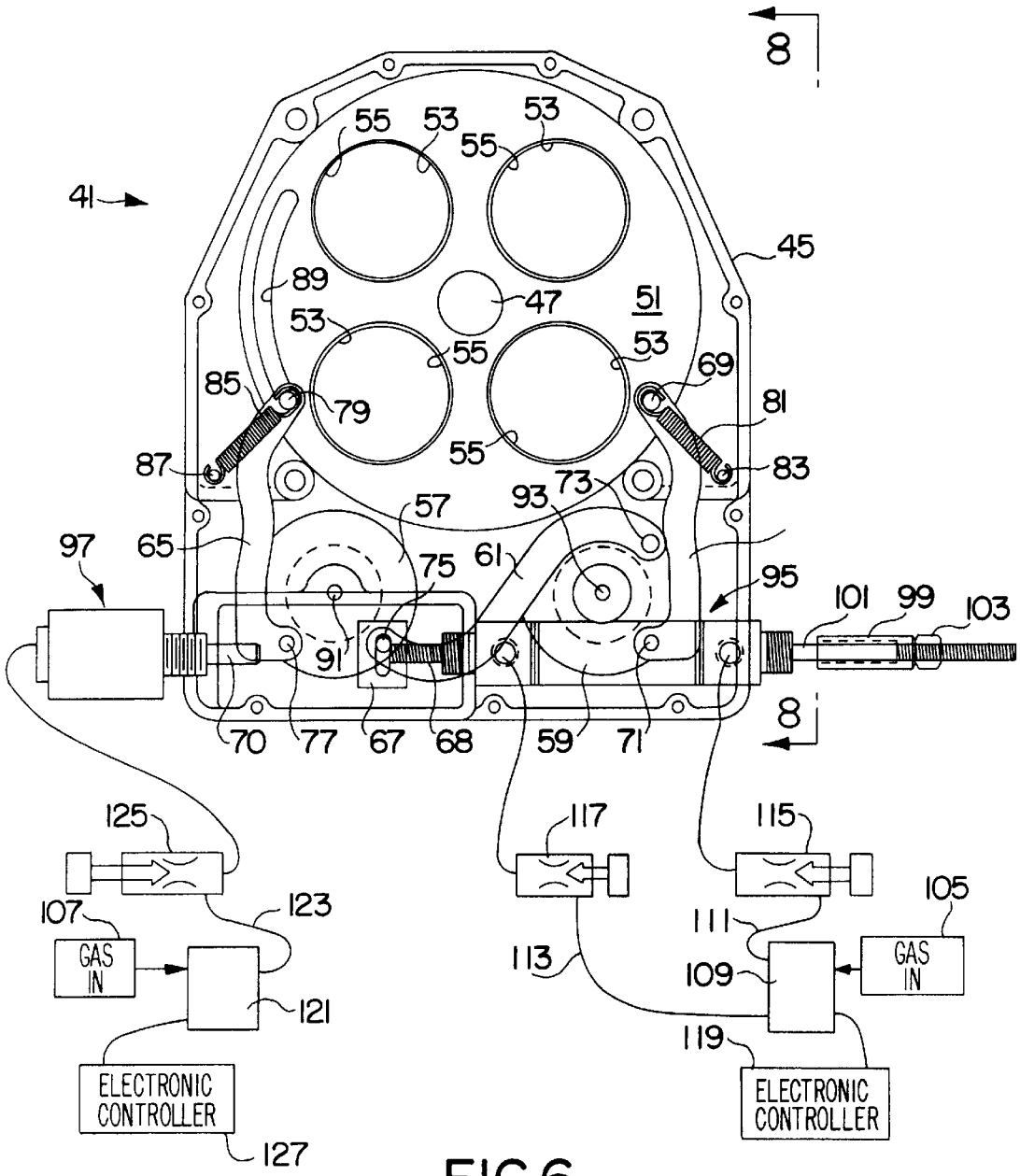

FIG. 6 is a top plan view, taken generally along the line and in the direction indicated by the arrows 6—6 in FIG. 5, of the assembled disc style throttle stop of the present invention. FIG. 6 shows the throttle stop in the wide open throttle condition.

Figure 7:
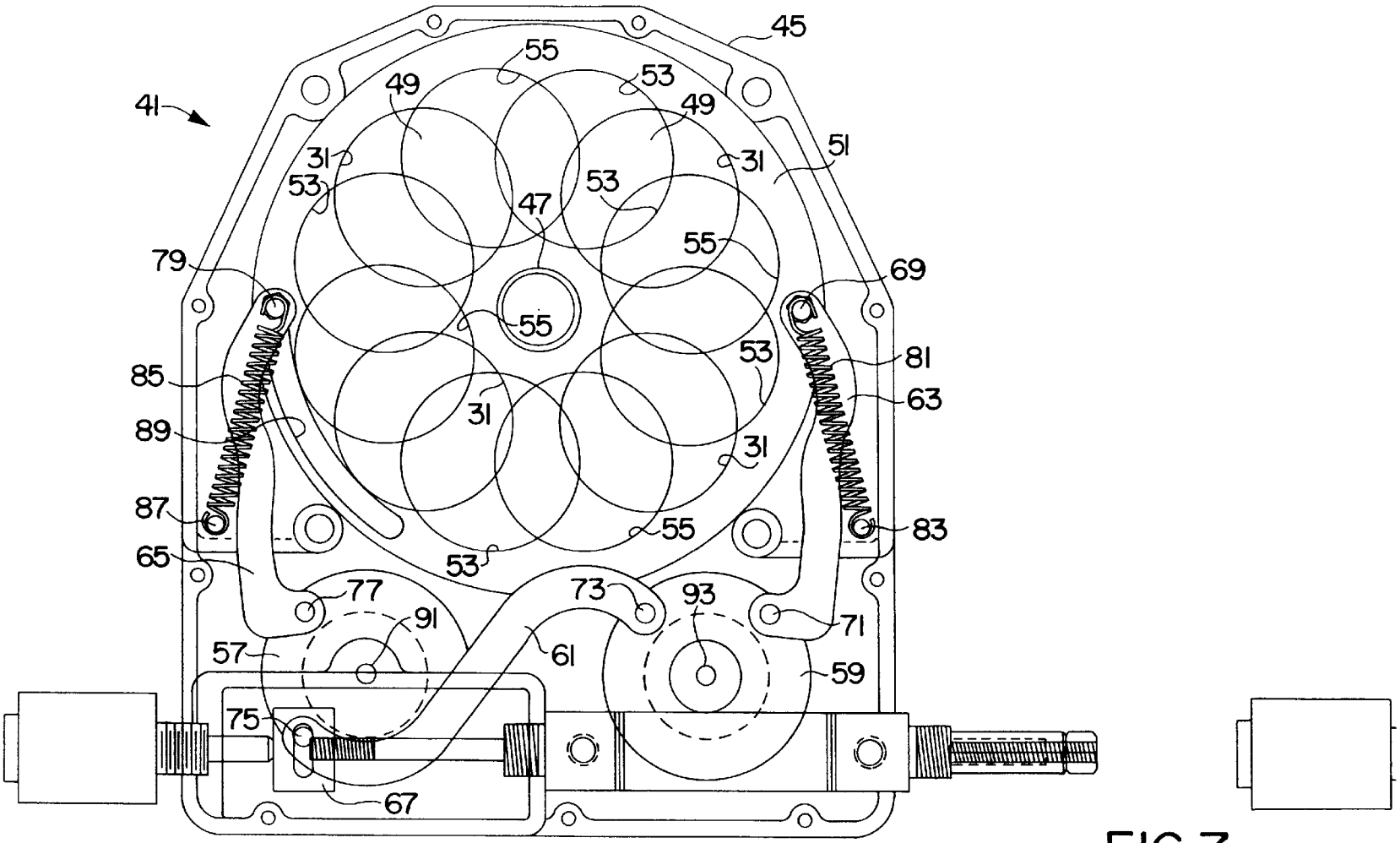

FIG. 7 is a top plan view like FIG. 6, but showing the assembled disc style throttle stop of the present invention in the fully closed position of the throttle stop.

Figure 8:
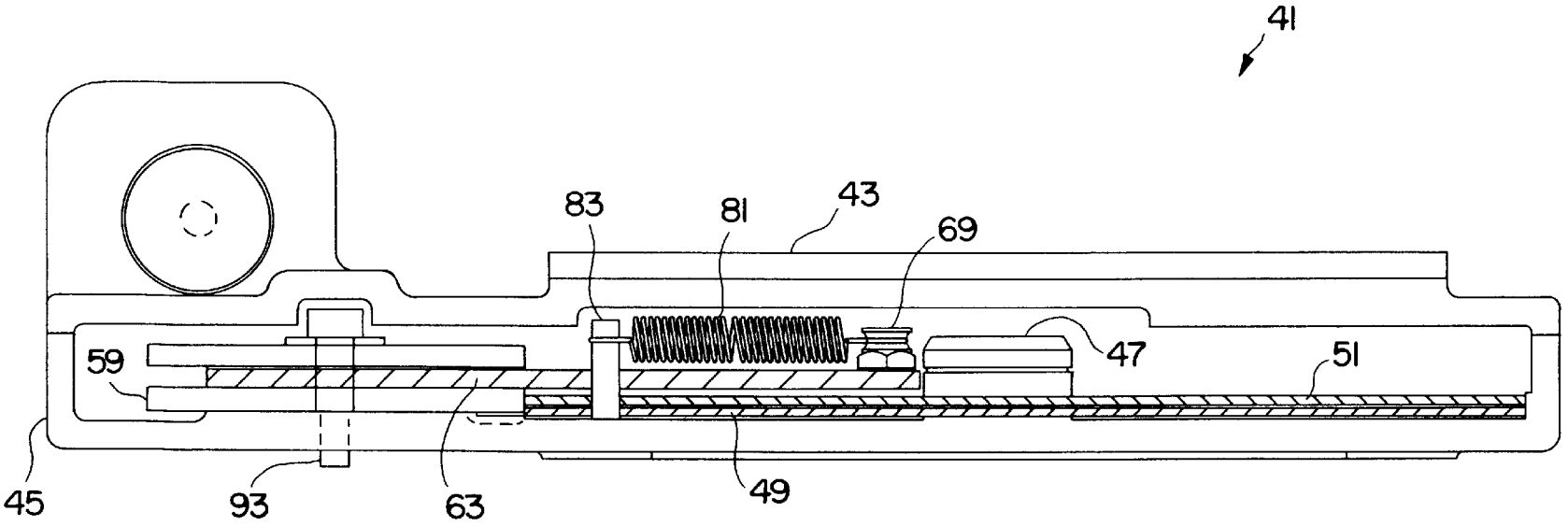

FIG. 8 is a side view, partly in cross section to show details of construction, of the assembled disc style throttle stop of the present invention. FIG. 8 is taken generally along the line and in the direction indicated by the arrows 8—8 in FIG. 6.

Figure 9:
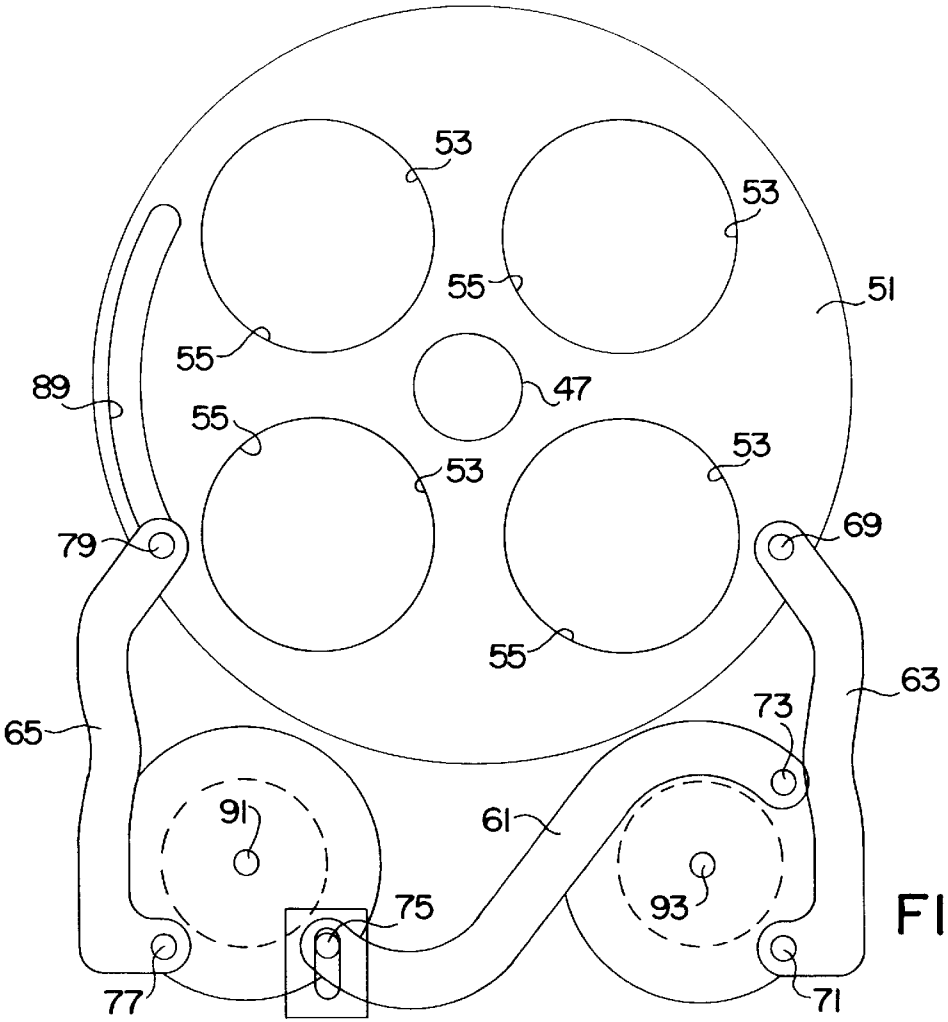

FIG. 9 is a top plan view showing the mechanism only of the disc style throttle stop. FIG. 9 shows the flow control discs, the drive linkage discs and the associated linkages. FIG. 9 shows the flow control discs in the fully open position.

Figure 10:
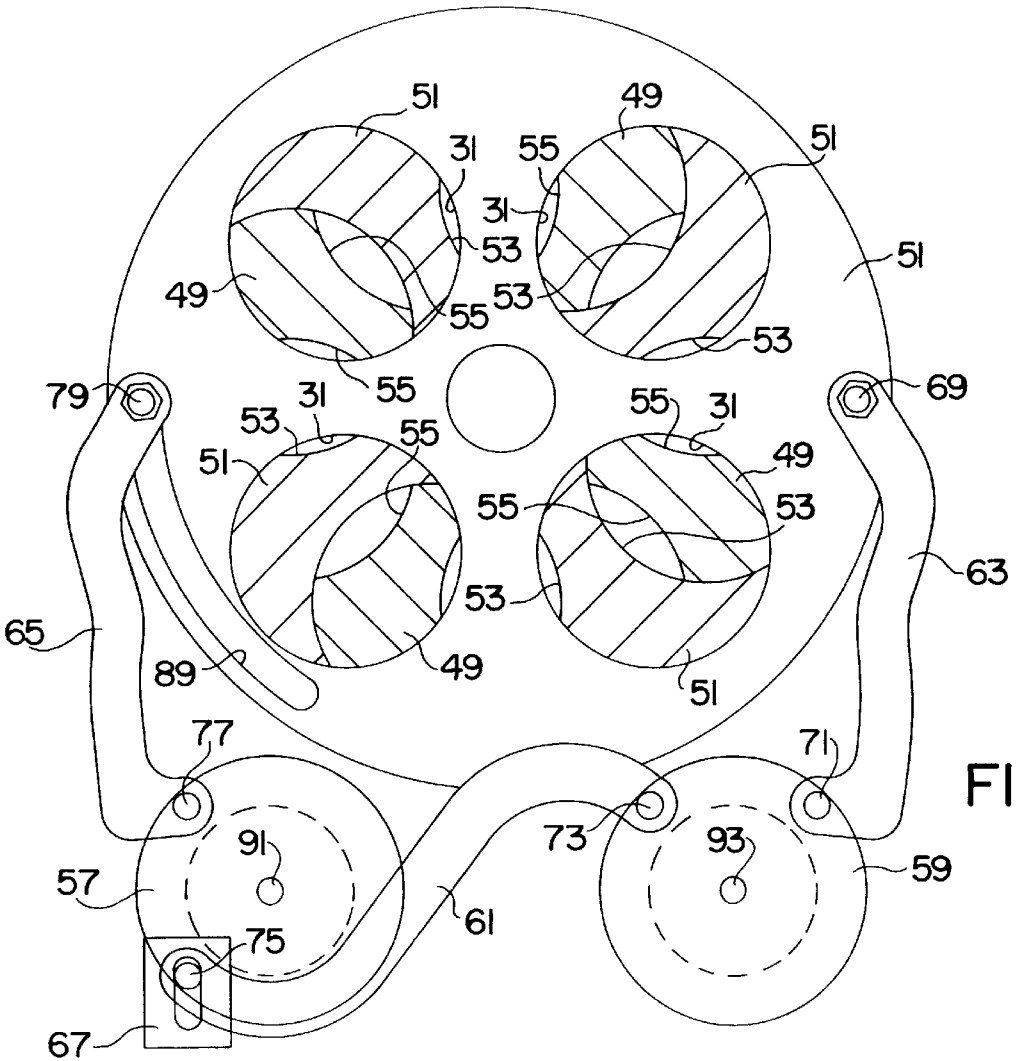

FIG. 10 is a top plan view like FIG. 9, but showing the mechanism in the fully closed position. In FIG. 10 the four heavily outlined circles show the fixed, unchangeable, locations of the four circular bores of the fuel metering device. In FIG. 10 the portions of the upper surfaces of two flow control discs which are directly beneath the four circular bores of the full metering device have been shown in cross-hatching (for purposes of illustration) so that the open areas of flow between the two flow control discs can be better seen as the uncross-hatched open areas. The upper flow control disc 51 is cross-hatched in lines which are inclined at 45° from the vertical. The lower flow control disc 49 is cross-hatched in lines which are vertical and horizontal. The portion of the upper surface of the upper flow control disc which is not aligned with the four circular bores of the fuel metering device is not shown in cross-hatching.

Figure 11:
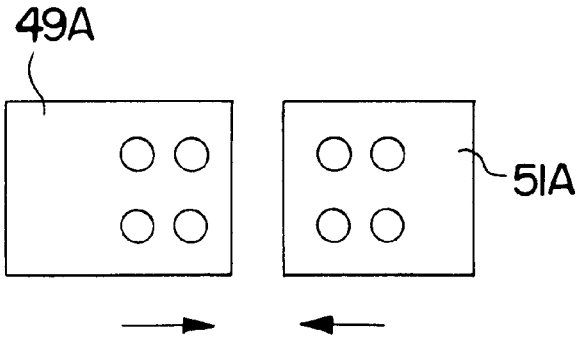

FIG. 11 is a top plan view of one alternative embodiment showing sliding plates used in place of the rotating discs of the FIG. 6 embodiment.

Figure 12:
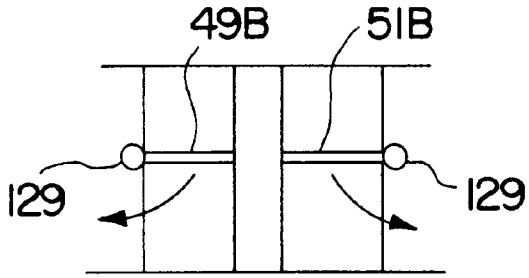
Figure 13:
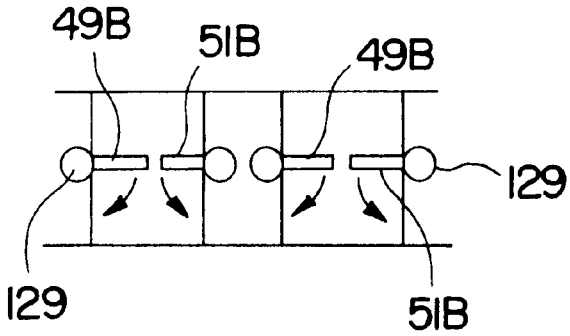

FIGS. 12 and 13 are side elevation views of two other embodiments in which flapper valves are located to the sides of the air flow path and the flapper valves rotate into the air stream. In these embodiments the throttle shafts are not located in the flow path, but are located to the sides of the flow path; and the plates rotate into the flow stream.

Figure 14:
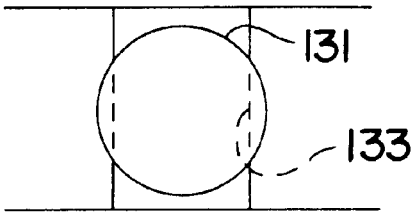
Figure 15:
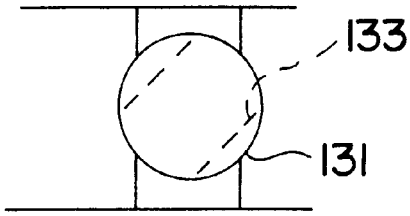

FIGS. 14 and 15 are top plan views of another embodiment in which a rotating rod has through holes. This embodiment comprises large diameter shafts that have holes bored through them that correspond to the fuel metering device holes. As the rods rotate, the through holes become covered and thus restrict the flow.

FIG. 16–21 are top plan views of other embodiments in which the linkage discs and connecting links of the FIG. 6 amendment are not used. Instead, other types of drive linkages are used.

Figure 16:
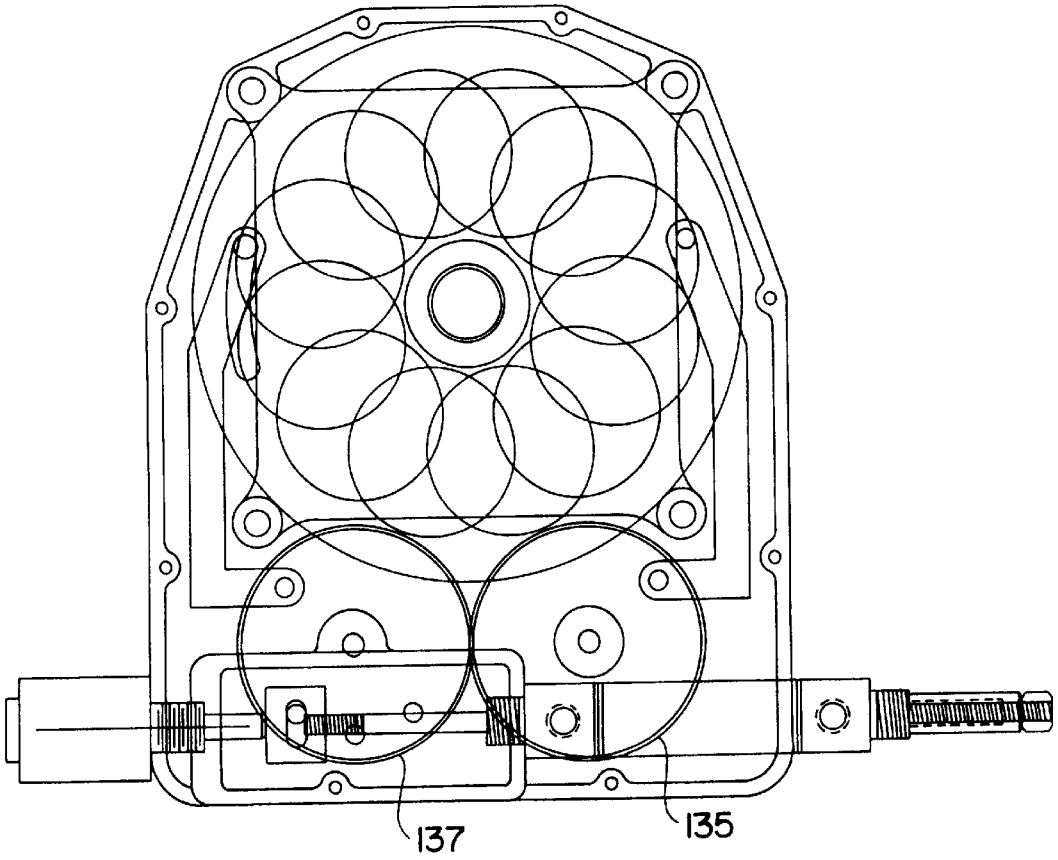
Figure 17:
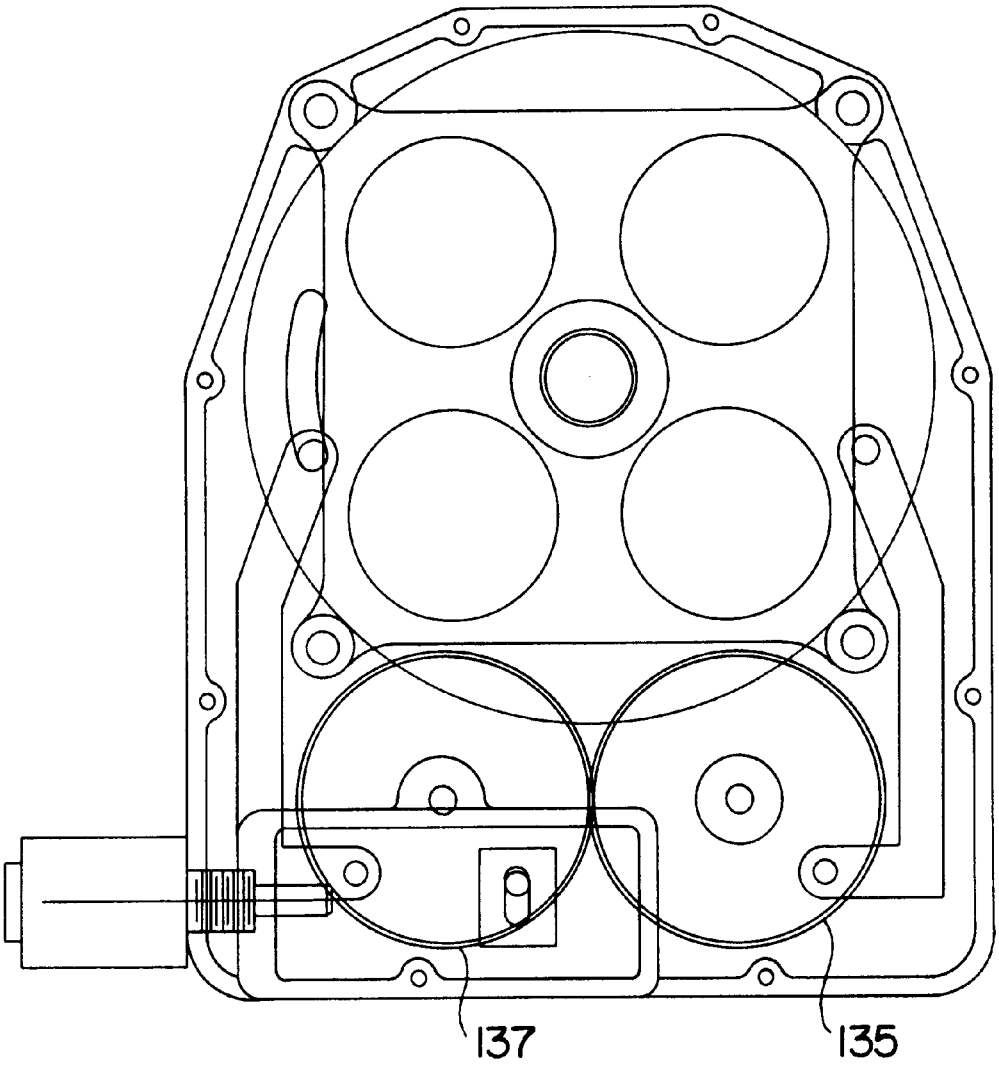
Figure 18:
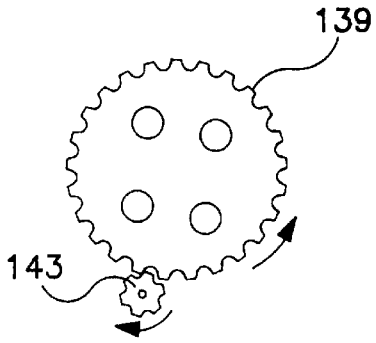
Figure 19:
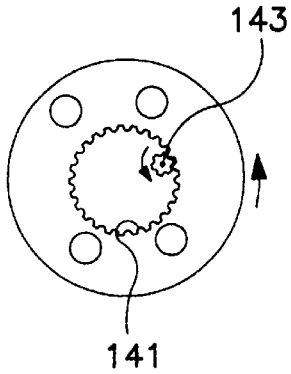

In the FIGS. 16 and 17 embodiment the drive linkages comprise rotating gears, and the linkage discs are replaced with meshing gears that eliminate the interconnect link.

Figure 20:
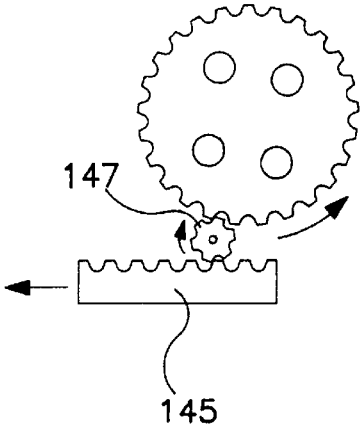
Figure 21:
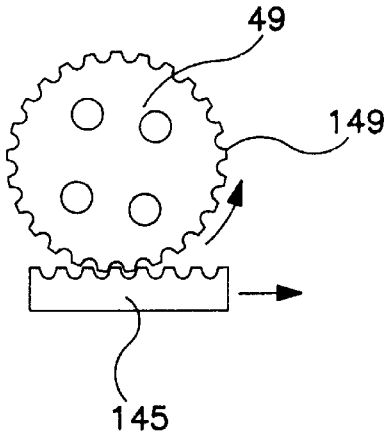

In the FIGS. 18–21 embodiments gear drive flow control discs are used. The flow control discs have gear teeth either on the outer periphery (FIGS. 18, 20 and 21) or on an inner surface (FIG. 19) and are driven directly with another gear (rotary) (FIGS. 18 and 20) or rack (linear)(FIGS. 20 and 21).

In the FIG. 20 embodiment a rack and pinion actuating linkage is used. A gear drives a rack connected to the air flow control disk.

In the FIG. 21 embodiment the disc or plate itself is a gear, and a rack drives it. This is particularly useful for a sliding plate type throttle stop.

In the FIGS. 22–26 embodiments, methods other than pneumatic cylinder operating discs and linkages are used. In one embodiment (not illustrated) an electric solenoid is used in place of the pneumatic actuator 95 in the FIG. 6 embodiment.

Figure 22A:
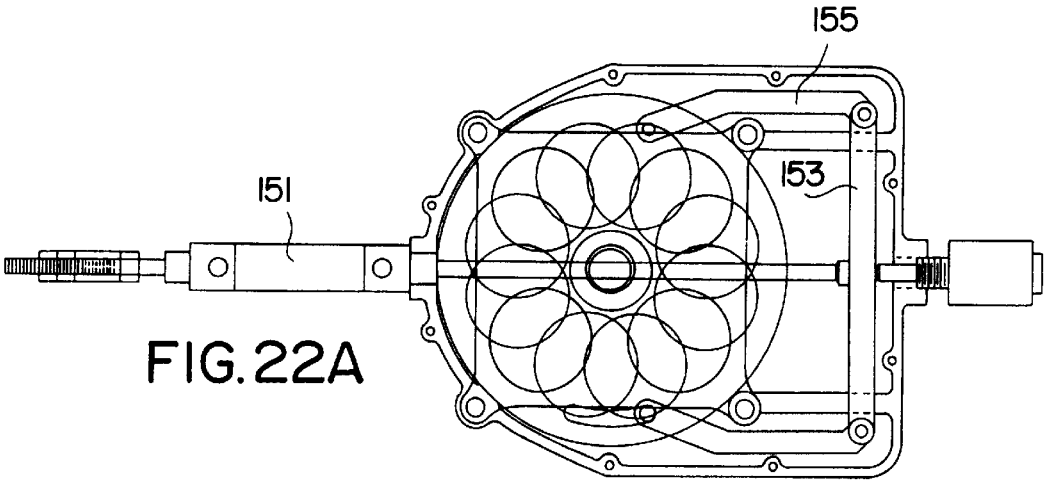
Figure 22B:
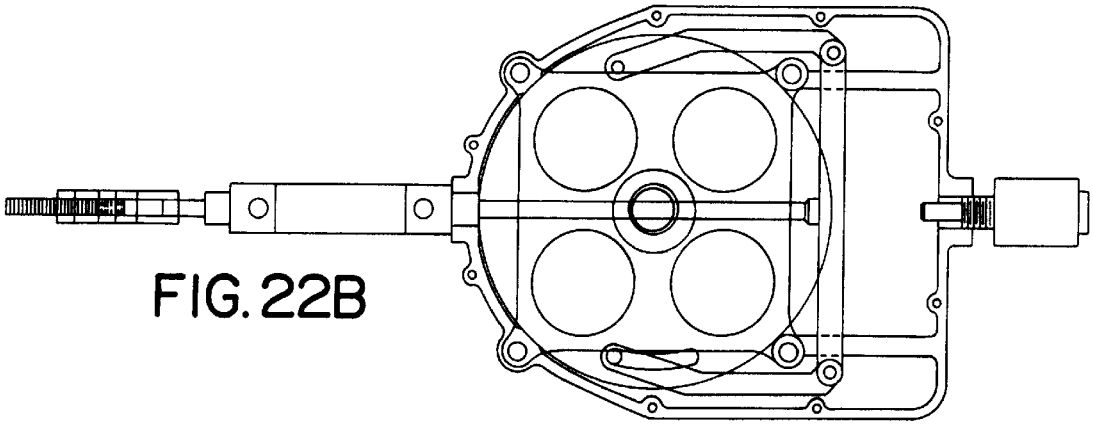

FIGS. 22A and 22B are top plan views of an embodiment in which a direct pneumatic actuator is used. The pneumatic cylinder is directly linked to the flow control discs.

Figure 23:
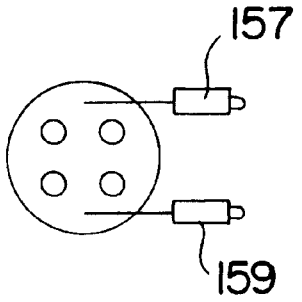

FIG. 23 is a top plan view of an embodiment in which dual cylinders are used to operate each disc individually.

Figure 24:
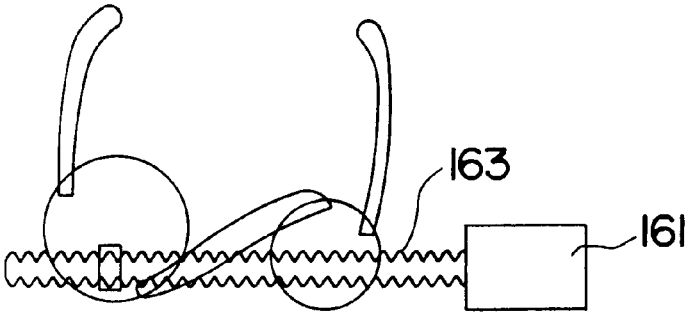

FIG. 24 is a top plan view of an embodiment in which DC or AC motors are also used in place of the pneumatic cylinders. A lead screw that is spun by a motor is used to create linear motion. Actuation speed is set by motor voltage or frequency.

Figure 25:
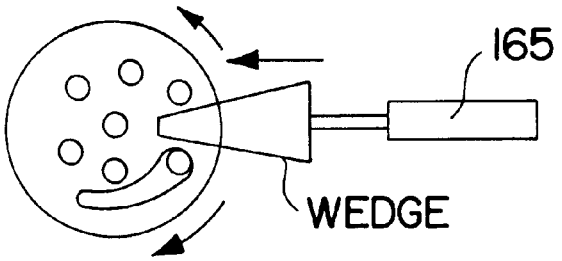

FIG. 25 is a top plan view of an embodiment in which a screw drive is used. The screw is driven by a source other than a motor.

In one embodiment (not illustrated) the source is an electric solenoid creating a rotary motion by means of proper linkages.

In another embodiment (not illustrated) the source is a rack and pinion driven by a pneumatic cylinder or by a small air turbine driven off compressed gas.

In another embodiment (not illustrated) a stepper motor (linear or rotary) is used. This is similar to DC and AC motors except that each pulse given to the motor causes the output shaft to step a specified amount of rotation or linear motion. In this embodiment infinite changes in speeds and stages of opening/closing are provided. This embodiment does not require a stop setting bolt since the position of the air flow disc is known by keeping track of how many steps were sent to the stepper motor.

Figure 26:
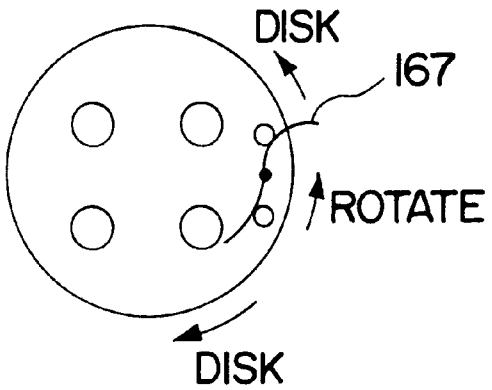

FIG. 26 is a top plan view of an embodiment in which cam operation is used. A cam (either rotary of linear) is used to operate the flow control plates in place of linkages or gears.

In another embodiment (not illustrated) engine oil is used in place of pneumatic or electrical means. Engine or transmission pressurized oil is used for the power source of the throttle stop actuator.

In other specific embodiments (not illustrated) two or more stage operation of the stop is provided instead of just one opening/closing position or rate.

In other embodiments of the present invention (not illustrated) the stop setting is adjustable. Means are provided to adjust one or all of the open/closed settings.

DETAILED DESCRIPTION OF THE PREFERRED EMBODIMENTS

As discussed above in the Background of the Invention, there are, in the prior art, two basic types of throttle stops.

One prior art type is a linkage style throttle stop which is a collapsible link within the throttle linkage between the gas pedal and the fuel metering device (carburetor or fuel injector).

The second and currently preferred type of throttle stop in the prior art is the baseplate style. In this throttle stop a second set of butterflies are located underneath the fuel metering device, and the second set of butterflies control the total air fuel flow mixture after the fuel has been injected into the air stream by the fuel metering device. The advantage of the baseplate style throttle stop during a race is that, at all times during a race, the fuel metering device runs at its optimum condition of wide open throttle.

The novel apparatus, methods and functions of the throttle stop of the present invention (a disc style embodiment of which is shown in FIGS. 5–10) can be better understood and appreciated by a brief review and some discussion of the apparatus, methods and functioning of a baseplate style prior art throttle stop (as illustrated in FIGS. 1–4).

This prior art baseplate style throttle stop will therefore now be briefly described, before beginning the detailed description of the preferred embodiments of the present invention.

FIG. 1 shows a fuel metering device which is indicated generally by the reference numeral 21.

The fuel metering device 21 is a carburetor having carburetor butterflies 23 mounted below a venturi section 37. The butterflies 23 are shown in the wide open throttle position in FIG. 1.

A prior art baseplate style throttle stop 25 is mounted below the carburetor 21 and between the carburetor 21 and an intake manifold 27. The baseplate throttle stop 25 has bores 29 aligned with respective bores 31 of the carburetor 21. Each bore 29 has a throttle stop butterfly 33.

In the condition illustrated in FIG. 1, the butterflies 33 are shown in the wide open position.

FIG. 2 is a view like FIG. 1 but including flow lines 35 drawn in to illustrate the flow path of the air/fuel flow in the fully open, wide open throttle condition of operation.

While it might not appear from the FIG. 1 view that the air/fuel flow would be hampered much from the lower set of butterflies 33 of the throttle stop, in practice the lower set of butterflies 33 do introduce a flow restriction and an unwanted source of turbulence.

Thus, as shown in FIG. 2, the air/fuel flow passing through the venturi section 37 of the carburetor expands after passing the carburetor butterflies 23. This air/fuel flow must then split and contract as it goes past the throttle stop butterflies 33. The throttle stop butterflies 33 introduce a flow restriction and an unwanted source of turbulence. The flow restriction and turbulence are indicated by the irregular shape of the flow lines 35 as the air/fuel flow passes by the throttle stop butterflies 33. The flow restriction and turbulence can produce a 10–50 horsepower loss in large displacement, high horsepower engines.

FIG. 3 is a side elevation view, like FIG. 1, but showing the prior art baseplate style throttle stop at the closed (restricted) condition of the butterflies 33 in the throttle stop 25.

FIG. 4 is a side elevation view like FIG. 3, but it includes flow lines 35 showing the path of the air fuel flow in the closed position of the throttle stop 25.

FIG. 4 illustrates how the throttle stop butterflies 33 in the closed position produce a major change and significant turbulence (including the turbulence indicated by the eddy currents 39) in the path of the air/fuel flow through the closed position of the prior art throttle stop 25.

It is an important feature of the present invention that a throttle stop constructed in accordance with the various embodiments of the present invention can be mounted underneath the fuel metering device or between the fuel metering device and the intake manifold or the intake valves of the engine and creates substantially no restriction to flow at wide open throttle conditions.

FIGS. 5–10 show one embodiment of a throttle stop 41 constructed in accordance with the present invention. The throttle stop 41 shown in FIGS. 5–10 is a disc style throttle stop.

The disc style throttle stop 41 shown in FIGS. 5–10 is mounted directly beneath a carburetor 21. The parts of the carburetor 21 which correspond to the parts of the carburetor 21 shown in FIGS. 1–4 are indicated by the same reference numerals.

The throttle stop 41 shown in FIGS. 5–10 comprises a body having a top half 43 and a bottom half 45. This body contains the moving parts. The two halves 43 and 45 of the body are bolted together, and the unit is mounted and sealed with gaskets between the intake manifold 27 and the fuel control device 21.

Two flow control discs are mounted inside the lower body half 45. The two flow control discs are mounted one above the other and have holes machined into them that correspond to the bores 31 of the fuel metering device 21.

As shown in FIG. 8, the bottom half 45 has a center pin 47. A bottom flow control disc 49 and a top flow control disc 51 are each mounted for rotation about the center pin 47.

As shown in FIGS. 6, 7 and 10, the top flow control disc 51 has holes 53 machined into it that correspond to the bores 31 of the fuel control device 21. The bottom flow control disc 49 has holes 55 machined into it that correspond to the bores 31 of the fuel metering device 21.

In the fully open opposition of the throttle stop 41 shown in FIG. 6, the holes 53 and 55 are both aligned with one another and with the related bores 31 of the fuel metering device 21.

In this fully open position of the throttle stop 41 the holes 53 and 55 provide perfectly open bores that match the fuel metering device bores. In this position there is substantially no restriction to air/fuel flow, so maximum engine horsepower is achieved. The pattern of air/fuel flow, as shown by the path lines 35 in FIG. 5, is a straight through uninterrupted and undeflected path.

In the fully closed position of the throttle stop 41 shown in FIG. 7 and in FIG. 10 the top flow control disc 51 has been rotated counter clockwise about the pin 47 and the bottom flow control disc 49 has been rotated clockwise about the pin 47 to the fully closed position of the throttle stop 41 to produce the minimum area of the openings for fuel/air flow shown in FIGS. 7 and 10.

In FIG. 10 the super imposed, four heavily outlined circles show the fixed, unchangeable locations of the four circular bores 31 of the fuel metering device 21.

In FIG. 10 the portions of the upper surfaces of the two flow control discs 49 and 51 which are directly beneath the four circular bores 31 of the fuel metering device 21 have been shown in cross-hatching (for purposes of illustration) so that the open areas of flow between the two flow control discs 49 and 51 can be better seen (as the uncross-hatched open areas) within the interior of the four heavily outlined circles corresponding to the bores 31 of the fuel metering device.

These bore 31 aligned portions of the upper flow control disc 51 are cross-hatched in lines which are inclined at 45° from the vertical.

These bore 31 aligned portions of the lower flow control disc 49 are cross-hatched in lines which are vertical and horizontal.

The surface of the upper flow control 51 which is not aligned with the four circular bores 31 is not shown in cross-hatching in FIG. 10.

FIG. 10 graphically illustrates the limitation on the cross-sectional area which is open for the air/fuel flow through the related holes 53 and 55 in the fully closed position of the throttle stop 41. The amount of flow is limited by the area of the openings (the uncross-hatched areas aligned with the bores 31).

Although the fully closed position of the throttle stop 41 (illustrated in FIGS. 7 and 10) reduces the area for air/fuel flow by the portions of the throttle stop 41 which are in line with the bores 31, the openings formed between these portions of the flow control discs 49 and 51 permit the same pattern of flow through the throttle stop 41 as illustrated in FIG. 5 for the wide open position of the throttle stop 41.

As illustrated in FIG. 5, the flow lines 35 (indicating the shape of the air fuel flow) show the lack of restriction and the continuation of existing flow patterns in the fully opened positions of the flow control discs 49 and 51. When the discs 49 and 51 are rotated to the fully open position, the holes 53 and 55 are aligned to form perfectly open bores that match the fuel metering device bores 37. In this position there is substantially no restriction to air/fuel flow so maximum engine horsepower is achieved.

In the fully closed position of the throttle stop 41 (with the flow control discs 49 and 51 positioned as illustrated in FIGS. 7 and 10), the fuel metering device 21 continues to have the carburetor butterflies fully opened in the wide open throttle condition of operation (as illustrated in FIG. 5). The amount of the air fuel flow is reduced to that which can be obtained through the reduced area openings (the uncross-hatched areas aligned with the bores 31), but the pattern of the air/fuel flow through the throttle stop 41 is the same as in the open position of the throttle stop 41.

The mechanism for rotating the flow control discs 49 and 51 back and forth between the fully opened position and the fully closed position comprise (as shown in FIGS. 9 and 10) a drive linkage disc 57, a slave linkage (or driven) disc 59, an interconnect link 61, a link bar 63, a link bar 65, a scotch yoke block 67, and pins 69, 71, 73, 75, 77, and 79.

The two link bars 65 and 63 connect the flow control discs 49 and 51 to the drive linkage disc 57 and the slave linkage disc 59.

The interconnect link 61 cross connects the drive linkage disc 57 and the slave linkage disc 59.

The drive linkage disc 57 is rotated by means of the scotch yoke block 67 which is attached to the end of a cylinder rod 68 of a main pneumatic actuator 95.

The scotch yoke block 67 is also engagable by an end of a cylinder rod 70 of a second pneumatic actuator 97 for repositioning of the flow control discs 49 and 51 as will be described in more detail below.

As shown in FIG. 7, an extension spring 81 is connected at one end to the pin 69 and is connected at its other end to a fixed pin 83 extending upwardly from the lower half 45.

Another extension spring 85 has one end connected to the pin 79 and has its other end connected to a pin 87 fixed to the lower body 45.

The upper flow control disc 51 has an arcuately shaped slot 89 formed in the lower left hand portion of the disc 51 (as viewed in FIG. 7 and in FIGS. 9 and 10) for permitting movement of the pin 79 within the slot 89 between the two positions of the upper flow control disc 51 shown in respective FIGS. 9 and 10.

The linkage disc 57 and 59 are held in place and rotate about their respective center pins 91 and 93.

All of the discs and links are connected together by the pins 69–79 which allow free rotation of the links 61, 63 and 65 about those pins.

The actuating means for actuating the mechanisms shown in FIGS. 9 and 10 include two pneumatically powered motors 95 and 97 as illustrated in FIGS. 6 and 7.

The main pneumatic actuator 95 has a cylinder rod 68. One end of the rod 68 is attached to the scotch yoke block 67.

A stop adjusting nut 99 is located on the end of a shaft 101 protruding out of the back (right hand side as viewed in FIG. 6 of the main actuator 95). The nut 99 is turned in and out to set the stroke of the main actuator 99 in the closed position of the throttle stop. This limits how far the flow control discs 49 and 51 can rotate and therefore how much of the flow can be choked off in the closed position. A lock nut 103 prevents the adjusting nut 99 from vibrating to an undesired setting.

The main pneumatic actuator 95 is activated by compressed gas supplied from a source 105.

The actuator 97 is activated by compressed gas supplied from a pressurized gas source 107. The pressurized gas sources 105 and 107 may be the same source.

The pressurized gas from the source 105 is supplied to the actuator 95 through a solenoid valve 109, conduits 1 1 1 and 113 and flow adjustor valves 115 and 117. The solenoid valve 109 is controlled by an electronic controller 119.

The compressed gas is supplied to the actuator 97 through a solenoid valve 121, a conduit 123 and a flow adjustor valve 125. The solenoid valve is controlled by an electronic controller 127.

The secondary actuator pneumatic cylinder 97 is threaded into the main body 43, 45 of the throttle stop 41 and is set either using shims between the cylinder body and the main body of the throttle stop or by rotating the cylinder and locking its position with a thin jam nut. The shim or jam nut choice is determined by the amount that the cylinder 97 is backed out. Moving the rod 70 of the actuator 97 into the main body (to the right as viewed in FIG. 6) increases the opening of the flow control disc at one or more intermediate opening positions.

The end of the rod 70 (as noted above) can engage the scotch yoke 67 to reposition the scotch yoke 67 and to therefore rotate the drive disc 57 in a counter-clockwise direction (as viewed in FIG. 6).

In operation, as the pneumatic cylinder rods 68 and 70 move in and out, the movement is changed into a rotary movement of the drive linkage disc 57 by means of the scotch yoke block 67.

The drive linkage disc 57, through its connection with the interconnect link 61, causes the slave linkage disc 59 to rotate in a direction opposite to the direction of rotation of the drive linkage disc 57. In the specific embodiment illustrated in FIG. 6, the drive ratios are set so that the motions of the links and disc are equal (the different rotations of the discs 57 and 59 are equal). However, different rotations and travels can be created easily by changing the linkage ratios.

The drive and slave linkage disc 57 and 59 now rotate in equal and opposite directions when the pneumatic cylinder rods 68 and 70 move in and out.

The linkage disc 57 and 59 are connected to the flow control disc 49 and 51 by means of the link bars 65 and 63. As the linkage disc rotates, the rotation is transmitted to the flow control disc which rotates in equal and opposite amounts also. As the flow control disc rotates, the machined holes partially cover each other, thus blocking engine air/fuel flow in the "closed" or "throttle stopped" condition. Rotating the disc in the opposite direction until the machined holes in the flow control disc line up results in a straight through shot with substantially no flow restrictions. This is the wide open or full throttle condition.

The springs 85 and 81 attached to the flow control disc 49 and 51 insure that the discs close all the way in the "closed" position, and they remove any backlash or play in the various pins, linkages, and joints.

The specific embodiment illustrated in FIG. 6 is a good combination of manufacturing costs, performance, accuracy, simplicity, and desirability.

In other embodiments of the present invention, different apparatus are utilized.

In one embodiment (see FIG. 11), sliding plates 49A and 51A are used in place of the rotating discs 49 and 51 of the FIG. 6 embodiment.

In another embodiment (see FIGS. 12 and 13), flapper valves 49B and 51 B are located to the side of the air flow path, and the flapper valves rotate into the air stream. In this embodiment the throttle shafts 129 are not located in the flow path, but are located to the side of the flow path; and the plates rotate into the flow stream.

In another embodiment (see FIGS. 14 and 15), a rotating rod 131 has through holes 133. This embodiment comprises large diameter shafts that have holes bored through them that correspond to the fuel metering device holes of the FIG. 6 embodiment. As the rods 131 rotate, the through holes 133 become covered and thus restrict the flow.

In other embodiments, the linkage discs and connecting links are not used. Instead, other types of drive linkages are used.

In one specific embodiment (see FIGS. 16 and 17) the drive linkages comprise rotating gears 135 and 137, and the linkage discs are replaced with meshing of the gears 135 and 137 that eliminate the interconnect link 61 of the FIG. 6 embodiment.

In another embodiment gear drive flow control discs are used. The flow control discs have gear teeth 139 or 141 either on the outer periphery (see FIG. 18) or on an inner surface (see FIG. 19). The gear teeth 139 or 141 are driven directly with another gear (rotary gear 143, see FIGS. 18 and 19) or another rack gear 145 (linear, see FIGS. 20 and 21).

In another embodiment (see FIG. 20) a rack 145 and pinion 147 actuating linkage is used.

In a specific embodiment (see FIG. 21) the disc 49 itself is a gear 149, and a rack 145 drives it. This is particularly useful for a sliding plate type throttle stop.

In other embodiments, methods other than pneumatic cylinder operating discs and linkages are used.

In one embodiment (not illustrated) an electric solenoid is used.

In another embodiment (see FIG. 22) a direct pneumatic actuator 151 is used. The pneumatic actuator cylinder 151 is directly linked to the flow control disc 49 by a linkage 153–155.

In another embodiment (see FIG. 23), dual cylinders 157–159 are used to operate each flow control disc 49 and 51 individually.

DC or AC motors are also used in place of the pneumatic cylinders (see FIG. 24). In this embodiment AC or DC motors 161 are used place of the pneumatic cylinders. A lead screw 163 that is spun by a motor 161 is used to create linear motion.

Actuation speed is set by motor voltage or frequency.

In another embodiment (see FIG. 25), a screw drive 165 is used. The screw is driven by a source other than a motor.

In another embodiment the source is an electric solenoid creating a rotary motion by means of proper linkages.

In another embodiment the source is a rack and pinion driven by a pneumatic cylinder or by a small air turbine driven off compressed gas.

In another embodiment a stepper motor (linear or rotary) is used. This is similar to DC and AC motors except that each pulse given to the motor causes the output shaft to step a specified amount of rotation or linear motion. In this embodiment infinite changes in speeds and stages of opening/closing are provided. This embodiment does not require a stop setting bolt since the position of the air flow disc is known by keeping track of how many steps were sent to the stepper motor.

Cam operation is used in another embodiment. See FIG. 26. A cam 167 (either rotary or linear) is used to operate the flow control plates in place of linkages or gears.

In another embodiment, engine oil is used in place of pneumatic or electrical means. Engine or transmission pressurized oil is used for the power source of the throttle stop actuator.

In other specific embodiments, two or more stage operation of the stop is provided instead of just one opening/closing position or rate.

In other embodiments of the present invention, the stop setting is adjustable. Means are provided to adjust one or all of the open/closed settings.

In all embodiments of the present invention, a throttle stop apparatus is mounted between the intake valves and an air metering device of the engine. The throttle stop apparatus is movable between a full open position and at least one flow restricting position. The power of the engine is regulated by actuating the throttle stop apparatus to a selected position to control the flow from the air metering device to the intake valves. The throttle stop apparatus is constructed to create substantially no restriction to said flow in said full open position at wide open throttle conditions of the engine.

The throttle stop apparatus and methods of the present invention permit regulation of the power of the engine by positioning of the throttle stop apparatus.

While I have illustrated and described the preferred embodiments of my invention, it is to be understood that these are capable of variation and modification, and I therefore do not wish to be limited to the precise details set forth, but desire to avail myself of such changes and alterations as fall within the purview of the following claims.

What is claimed is:

1. A throttle stop apparatus for selectively regulating the power of an internal combustion engine of the kind having intake valves and an air-fuel metering device, said throttle stop apparatus comprising, a body that permits the throttle stop apparatus to be mounted in the flow path between the air-fuel metering device and the intake valves of the engine, throttle stop means within the body and moveable between a full open position and at least one flow restricting position for selectively regulating the power of the engine by controlling the flow from the air-fuel metering device to the intake valves, said throttle stop means being constructed to create substantially no restriction to said flow in said full open position at wide open throttle conditions of the engine and wherein the throttle stop means comprise at least a first plate and a second plate, each plate having an opening with a configuration and dimensions sufficient to create substantially no restriction to said flow in said full open position of the throttle stop means, and including actuating means for moving at least one plate relative to another to provide full alignment of said openings in said full open position at wide open throttle conditions of the engine and to provide at least partial restriction to said flow at said flow restricting position of the throttle stop means.

2. The invention defined in claim 1 wherein the power is regulatable by the positioning of the throttle stop means.

3. The invention defined in claim 2 wherein the air-fuel metering device includes carburetor apparatus.

4. The invention defined in claim 2 wherein the air-fuel metering device includes an air flow measurement transducer and fuel injection nozzles.

5. The invention defined in claim 1 wherein the plates are movable laterally with respect to one another.

6. The invention defined in claim 1 wherein the plates are rotatable with respect to one another.

7. The invention defined in claim 1 wherein the actuating means are pneumatically powered.

8. The invention defined in claim 7 including adjustable pneumatic flow limiting means in the pneumatically powered actuating means.

9. The invention defined in claim 8 wherein the throttle stop means are movable between a first, full open position, a second position which produces a certain amount of restriction of said flow from the air-fuel metering device to the intake valves, and a third position in which third position the throttle stop means produce a different restriction to said flow than in said second position.

10. The invention defined in claim 9 wherein the pneumatically powered actuating means include a first actuator connected to open and close the throttle stop means between a first selected pair of said positions and a second actuator connected to open and close the throttle stop means between another, second selected pair of said positions.

11. The invention defined in claim 10 wherein said adjustable pneumatic flow limiting means permit a plurality of distinctive actuation speeds for the first and second actuators.

12. The invention defined in claim 1 including adjustable means for adjusting the setting for said flow restricting position of the throttle stop means.

13. The invention defined in claim 1 including electronic timing means for activating the actuating means.

14. The invention defined in claim 2 wherein the throttle stop means are located below and closely adjacent to the air-fuel metering device.

15. The invention defined in claim 6 wherein the plates are circular flow control discs and wherein each circular flow control disc is rotatable about its center and including a first drive linkage disc and a second slave linkage disc for rotating the respective flow control discs in opposite directions and including linkage bars interconnecting the drive linkage discs and the flow control disc.

16. The invention defined in claim 15 including a first main actuator pneumatic cylinder for rotating the first drive linkage disc and the second slave linkage disc to move the flow control discs between a first wide open position and a second closed position which produces a certain amount of restriction of said flow from the air-fuel metering device to the intake valves.

17. The invention defined in claim 16 including a secondary actuation pneumatic cylinder connectable to the drive linkage disc for rotating the drive linkage disc to a position in which the flow control discs assume a third position in which the flow control discs produce a different restriction to said flow than in said second position.

18. The invention defined in claim 1 wherein the actuating means include an electric motor.

19. The invention defined in claim 1 wherein the actuating means include a stepper motor.

20. The invention defined in claim 1 wherein the actuating means include a solenoid.

21. A method of selectively regulating the power of an internal combustion engine of the kind having intake valves and an air-fuel metering device, said method comprising, mounting a throttle stop apparatus between intake valves and an air-fuel metering device of the engine, said throttle stop apparatus being moveable between a full open position and at least one flow restricting position, regulating the power of the engine by actuating the throttle stop apparatus to a selected position to control the flow from the air-fuel metering device to the intake valves, said throttle stop apparatus being constructed to create substantially no restriction to said flow in said full open position at wide open throttle conditions of the engine and wherein the throttle stop apparatus comprises at least two movable plates which are constructed to have configurations and dimensions which create substantially no restriction to said flow in said full open position and which provide at least partial restriction to said flow at said flow restricting position.

22. The method defined in claim 21 wherein each of the movable plates is a flapper valve mounted for rotation with a rotatable throttle shaft and wherein the throttle shafts and flapper valves are located to the side of said flow and wherein the throttle shafts are actuated to rotate the movable plates into said flow to control said flow from the air-fuel metering device to said intake valves.

* * * * *